US009486097B2

(12) United States Patent
Werth

(10) Patent No.: US 9,486,097 B2
(45) Date of Patent: Nov. 8, 2016

(54) DISPLAY RACK FOR DENSELY-HUNG FOLDING WALKERS

(71) Applicant: Christopher J. Werth, Grand Rapids, MI (US)

(72) Inventor: Christopher J. Werth, Grand Rapids, MI (US)

( * ) Notice: Subject to any disclaimer, the term of this patent is extended or adjusted under 35 U.S.C. 154(b) by 0 days.

(21) Appl. No.: 14/980,330

(22) Filed: Dec. 28, 2015

(65) Prior Publication Data

US 2016/0198851 A1 Jul. 14, 2016

Related U.S. Application Data

(60) Provisional application No. 62/103,125, filed on Jan. 14, 2015.

(51) Int. Cl.

| | |
|---|---|
| ***A47G 25/12*** | (2006.01) |
| ***A47B 81/00*** | (2006.01) |
| ***A61H 3/00*** | (2006.01) |
| ***A47B 95/00*** | (2006.01) |
| ***A45B 1/00*** | (2006.01) |
| ***A61H 3/02*** | (2006.01) |

(52) U.S. Cl.

CPC ..... *A47G 25/12* (2013.01); *A45B 1/00* (2013.01); *A47B 81/00* (2013.01); *A47B 95/008* (2013.01); *A61H 3/00* (2013.01); *A61H 3/0244* (2013.01)

(58) Field of Classification Search

CPC ..... A47G 25/12; A61H 3/0244; A61H 2003/0261; A61H 2003/0255; A61H 3/00; A45B 1/00; A45B 7/005; A45B 9/04; A47B 81/00; A47B 95/008

USPC ..... 211/62, 63

See application file for complete search history.

(56) References Cited

U.S. PATENT DOCUMENTS

| | | | | | |
|---|---|---|---|---|---|
| 424,041 | A * | 3/1890 | Ward | A47G 25/12 | 211/63 |
| 456,175 | A * | 7/1891 | Van Orman | A47G 25/12 | 211/120 |
| 508,602 | A * | 11/1893 | Danner | A47G 25/12 | 211/62 |
| 706,718 | A * | 8/1902 | Bradbury | B62H 3/00 | 211/163 |
| 760,866 | A * | 5/1904 | Hohoff | A47G 25/12 | 211/63 |
| 799,931 | A * | 9/1905 | Nordenstierna | A47G 25/12 | 211/63 |
| 1,013,662 | A * | 1/1912 | Kramer | A47G 25/12 | 211/62 |
| 1,404,893 | A * | 1/1922 | Robertson | A47G 25/12 | 211/70.2 |
| 1,406,097 | A * | 2/1922 | Snickers | A47G 25/12 | 211/63 |
| 3,394,790 | A * | 7/1968 | Braun | A63C 11/007 | 194/256 |
| 3,675,783 | A * | 7/1972 | Reese | B65F 1/141 | 211/85.19 |
| 2008/0061016 | A1* | 3/2008 | Nicolopulos | A47F 5/02 | 211/62 |
| 2008/0257392 | A1* | 10/2008 | Stricevic | A45B 1/00 | 135/66 |

* cited by examiner

*Primary Examiner* — Korie H Chan

(74) *Attorney, Agent, or Firm* — Price Heneveld LLP

(57) ABSTRACT

A storage device is provided for holding folding walkers in an arrangement provide easy access for cleaning, retrieval, adjustment, and repair. The storage device includes: an upper support component with horizontally-spaced J-hooks, and a lower support component with horizontally-spaced U-hooks. The J-hooks and U-hooks are arranged so that an upper portion (tube) of the frame of a folded walker can be engaged with a selected one of the J-hooks while a lower portion of the frame engages a selected U-hook and remains in place via gravity. A related method includes rotating hung walker frames to visually inspect, select, and then remove a selected one walker frame.

16 Claims, 3 Drawing Sheets

DISPLAY RACK FOR DENSELY-HUNG FOLDING WALKERS

CROSS-REFERENCE TO RELATED APPLICATION

This application claims benefit under 35 USC §119(e) of U.S. Provisional Application Ser. No. 62/103,125, filed Jan. 14, 2015, entitled RACK FOR HANGING FOLDING WALKERS the entire contents of which are incorporated herein by reference.

BACKGROUND OF THE INVENTION

The present invention relates to a hanger providing easy visual access and accessibility and space-saving storage for folding walkers. More specifically, the invention allows multiple folded walkers to hang vertically next to one another with 180 degrees of freedom for rotation, thus allowing easy selection of a particular walker with desired accessories.

Folding walkers are utilized and stored in a variety of settings including: hospitals, rehabilitation clinics, extended care facilities, nursing homes, distributor warehouses, and universities with medically related programs. Typically, the walkers are designed to extend around three sides of a user, so that they provide stability to a user when walking. However, currently there is a lack of efficient storage for these assistive devices, which raises several concerns. For example, lack of efficient storage causes the walkers to take up a lot of storage space. Also, walkers that are recently put into a storage area block access to walkers that are already in the storage area, thus making it difficult to access the "first-in" walkers . . . resulting in a variety of concerns, such as poor sanitation, reduced healthcare productivity, and an excessively-large required allotted storage space. For example, depending on the setting and the frequency for which a folding walker is chosen as an appropriate assistive device, storage rooms can hold upwards of 40-50 folding walkers. Most frequently these walkers are folded-up and leaned against a back wall, stacking three to four walkers deep. This requires facilities to maintain a relatively large square-footage solely to accommodate and house their folding walkers.

Infection control is of upmost concern in all medically related facilities. Leaning multiple folding walkers against one another increases risk of disease transmission. Due to the lack of secure storage, it is common for multiple walkers to fall on the contaminated floor when an individual tries to retrieve a device. Also, "first-in" walkers may not be maintained as well as "last-in" walkers. Thus, again raising concern for infection control.

Walkers are provided with various accessories and designs to accommodate particular patient needs. Because of immense patient variability and need, healthcare providers must consider a variety of variables when prescribing the correct type of folding walker. For example, folding walkers can have standard four-point legs with different bottoms, such as large wheels or small wheels or legs with tennis balls to aid in gliding. Also, walkers have different brakes, different heights and sizes (e.g. ranging from pediatric to bariatric). Due to this variability and the current state of unorganized storage, it often takes healthcare providers a measurable amount of time to locate, retrieve and appropriately adjust a desired folding walker. This increases set-up and preparatory time, decreasing the amount of available time for therapeutic intervention. If the healthcare provider is unable to find the correct folding walker and utilizes a less effective model, this can cause long-term gait deviations, induce unnecessary cardiac stress, or possibly deter early patient mobility.

It is known to hang multiple folding walkers on a wall for storage. However, known current storage systems either include two rods or hooks that project outwardly from the wall. Three to four folded walkers can be hung on the rods/hooks, with the rods/hooks extending under the support bars of the walker. However, this method requires "stacking" the walkers consecutively, which limits availability to "first-in" walkers that are placed behind the "outer" walkers. Storage volume is compromised. Also, it is difficult to see the "first-in" walkers, thus making it difficult to find a particular walker.

These and other features, advantages, and objects of the present invention will be further understood and appreciated by those skilled in the art by reference to the following specification, claims, and appended drawings.

SUMMARY OF THE INVENTION

In one aspect of the present invention, a storage device is provided for storing walkers each having a frame on a vertical support surface. The storage device comprises a plurality of upper retainers on the support surface, each shaped to engage an upper portion of a selected walker frame and hold the walker frame vertically against gravity and also hold the walker frame horizontally adjacent the vertical support surface while permitting rotation of the walker frame about a vertical axis for optimal viewing of the walker frame; and a plurality of lower retainers on the support surface, each shaped to engage a lower portion of the walker frame and thus hold the lower portion stably below the upper portion.

In another aspect of the present invention, a method of storing folding walkers comprises providing a plurality of upper retainers on a wall-simulating support surface, each shaped to engage an upper portion of a selected walker frame and hold the walker frame vertically against gravity and also hold the walker frame horizontally adjacent the vertical support surface while permitting rotation of the walker frame about a vertical axis for optimal viewing of the walker frame; providing a plurality of lower retainers each shaped to engage a lower portion of the walker frame and thus hold the lower portion stably below the upper portion; and hanging a plurality of folded walker frames on the wall-simulating support surface by engaging an upper portion of each walker frame on a selected one of the upper retainers to support the walkers' weight, with a lower portion of each selected one walker frame engaging the lower retainer for vertical stability.

An object of the present invention is to provide an apparatus that mounts to any wall at a desired height (or that stands independently as a rack in a wall-simulating position). The walker-retainer system allows folding walkers to hang vertically and independently of one another, enabling efficient storage and removal. The storage solution allows each walker to swing bilaterally for optimal viewing, thus allowing a worker to better locate and retrieve a "correct" folding walker in a timely manner. The suspended position of stored walkers also lends itself to allowing individuals to easily change leg height, wheels (and floor-engaging parts), and brakes prior to removing from the wall-hung position. This unique apparatus helps decrease required storage space, while maximizing healthcare workers' productivity. The innovative system also helps reduce disease transmission by reducing walker-to-walker contact and reducing a likelihood of walkers falling on a contaminated floor. Because there are a wide variety of facilities with varying needs, the apparatus can be customized to any length, providing storage to varying amounts of folding walkers. Though illustrated as wall-mounted, it is contemplated that the present apparatus can be mounted on any vertical structure, or used on a free-standing support.

These and other aspects, objects, and features of the present invention will be understood and appreciated by those skilled in the art upon studying the following specification, claims and appended drawings.

DETAILED DESCRIPTION OF PREFERRED EMBODIMENT

A storage device is provided for holding folding walkers having a frame. The storage device comprises a vertical support surface (e.g. a building wall or wall-simulating vertical support surface); a plurality of upper retainers (e.g. J-hooks) on the support surface, each shaped to engage an upper portion of a selected walker frame and hold the walker frame vertically against gravity and also hold the walker frame horizontally adjacent the vertical support surface while permitting rotation of the walker frame about a vertical axis for optimal viewing of the walker frame; and a plurality of lower retainers (e.g. U-hooks) on the support surface, each shaped to engage a lower portion of the walker frame and thus hold the lower portion stably below the upper portion.

A related method of storing folding walkers comprises providing a plurality of upper retainers on a wall-simulating support surface, each shaped to engage an upper portion of a selected walker frame and hold the walker frame vertically against gravity and also hold the walker frame horizontally adjacent the vertical support surface while permitting rotation of the walker frame about a vertical axis for optimal viewing of the walker frame; providing a plurality of lower retainers each shaped to engage a lower portion of the walker frame and thus hold the lower portion stably below the upper portion; and hanging a plurality of folded walker frames on the wall-simulating support surface by engaging an upper portion of each walker frame on a selected one of the upper retainers to support the walkers' weight, with a lower portion of each selected one walker frame engaging the lower retainer for vertical stability.

In a narrower form, the upper and/or lower retainers are carried by a subframe attachable to a support surface of a building wall, the subframe being a pair of horizontal beams (e.g. channels or tubes).

Figure 1:
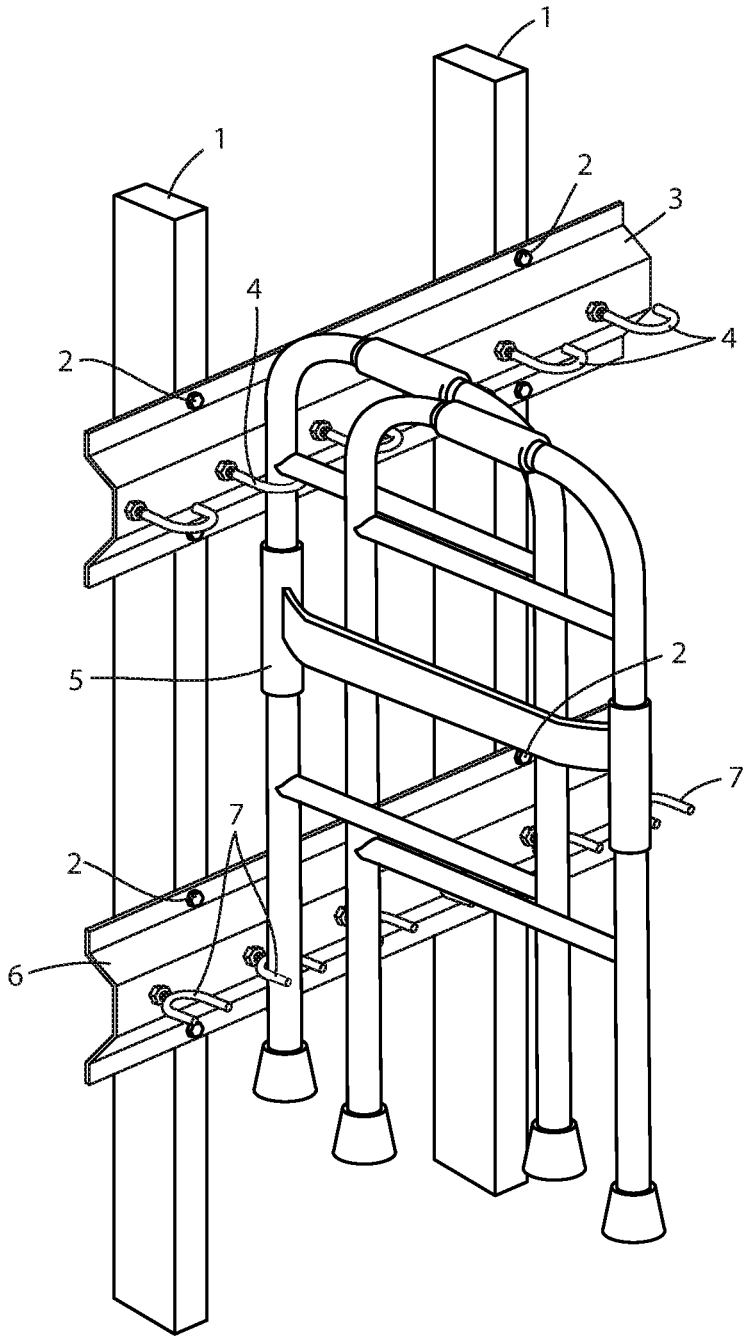
FIG. 1 is a perspective view showing top J-hook connectors supporting a walker and bottom U-hook connectors maintaining vertical device positioning.
Figure 2:
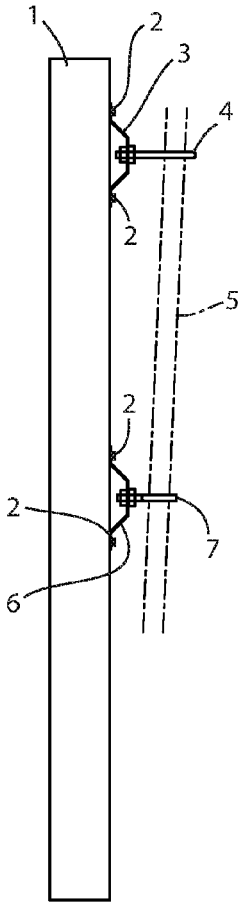
FIGS. 2-3 are side and front views of FIG. 1.
Figure 3:
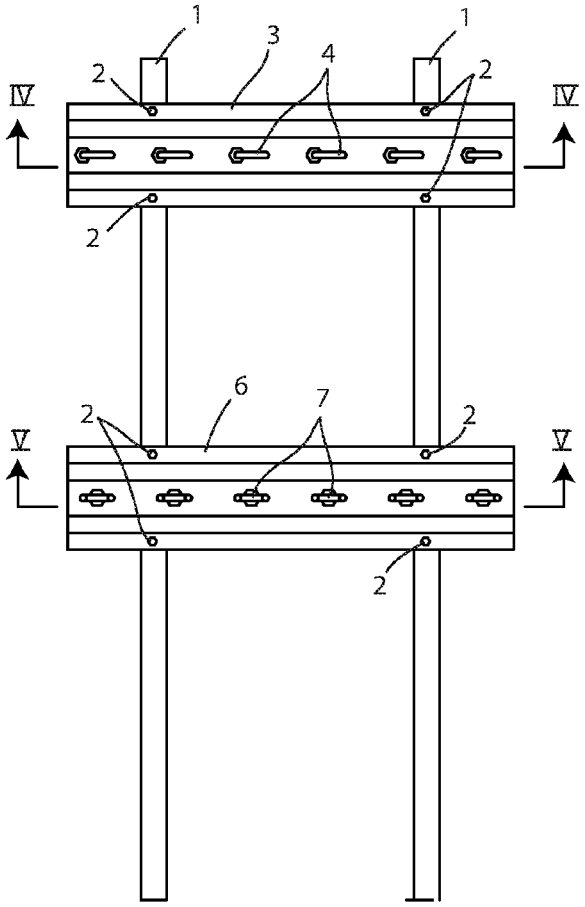
Figure 4:
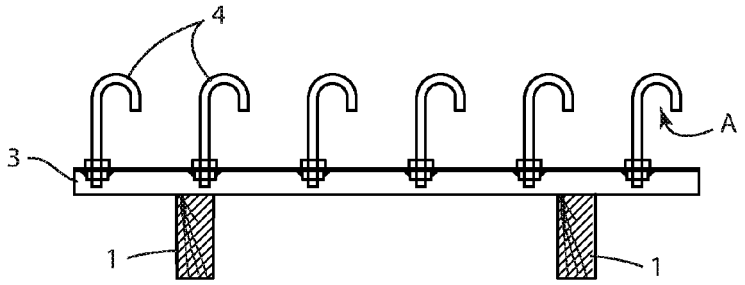
FIGS. 4-5 are cross sectional views along lines IV-IV and V-V in FIG. 3.
Figure 7:
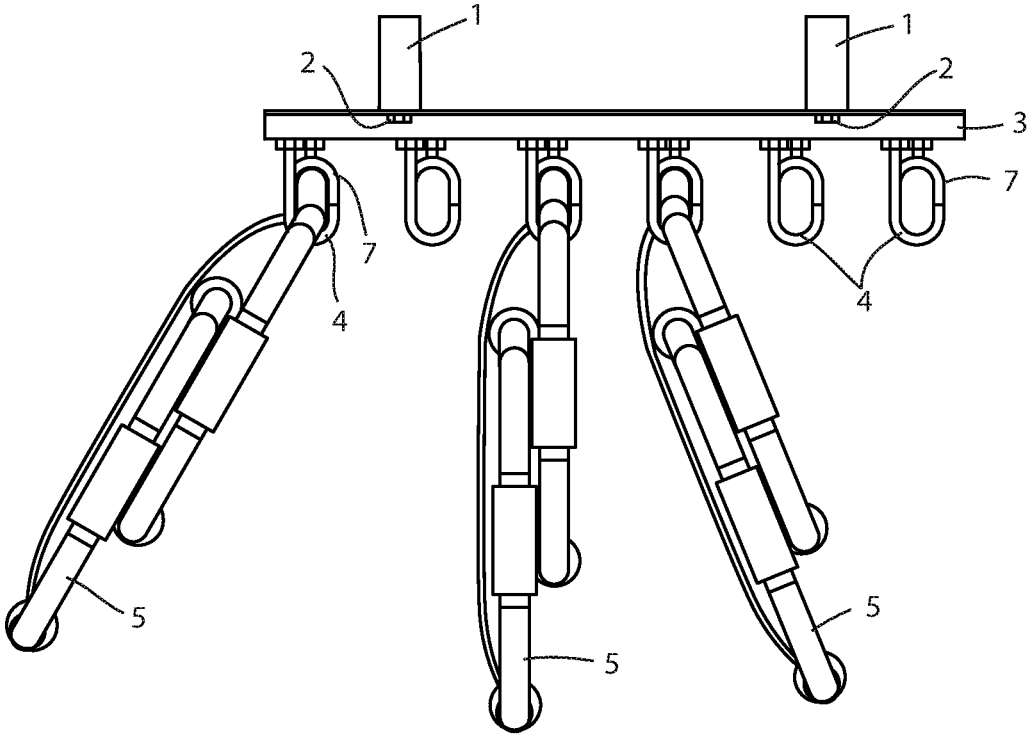
FIG. 7 is a top view similar to FIG. 6 but showing three walkers supported and angled relative to each other for optimal viewing.

The illustrated apparatus (FIG. 1) includes two separate vertically-spaced support components such as metal channels 3 and 6 (also called "sections" or "supports" herein) fastened to a wall (i.e. illustrated as two 2×4 studs (1) in a dry-wall-covered wall) using mounting tabs, screws (2), or anchors. The illustrated channels 3 and 6 are bent 12 gauge aluminum or stainless sheet metal, but it is contemplated that instead of channels, any horizontal structural member can be used, such as a tube or hat-shaped channel. The top support section (3) contains horizontally-spaced-apart, lateral facing J-hooks (4) (i.e. upper retainers). An upper portion of the illustrated folded walkers are inserted laterally along path A (FIG. 3) into the J-hooks. The walker frames (5) include a superior support bar that rests on top of the J-hooks (FIG. 1), supporting a weight of the walker frame and securing each walker in place. The J-hook design allows for the walkers to swivel laterally without falling, making it easy to sort through walkers when choosing a specific device (FIG. 7).

Figure 5:
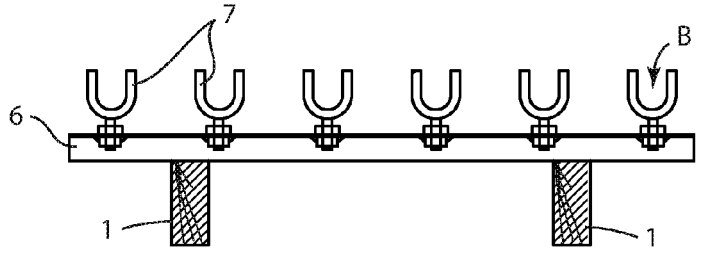
Figure 6:
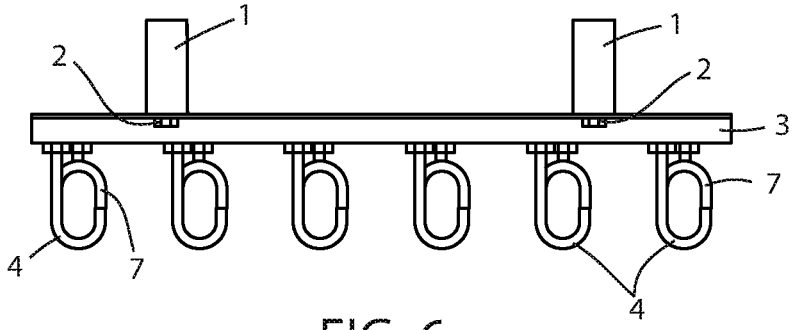
FIG. 6 is a top view of FIG. 1.

The bottom support section (6) (FIG. 1) includes horizontal U-hooks (7) (also called "lower retainers") which hold the walkers in a vertical position (FIG. 1) without restricting lateral excursion (i.e. they keep the walker frame vertically under the J-hooks (4). The walker frame (5) engages the U-hooks along a path B (FIG. 5). Thus, the walkers can be rotated (i.e. rotatable about a vertical axis defined by the retainer 4 and 7) for easy viewing and selection (FIG. 7). Each J-hook (4) has a corresponding U-hook (7) therebelow, so that the pairing can hold one walker, yet permit rotation for viewing, cleaning, repair, adjustment, and/or selection and removal. Each pair is preferably a minimum horizontal distance of 4.5 inches from the next pair to ensure sufficient room for rotation of each walker. To correctly fit most folding walkers, the lower edge of the top support section must be about 11 inches from the upper edge of the bottom support section. However, spacing can be adjusted to optimal dimensions for any given circumstance.

To further decrease required storage space, two racks can be hung one over the other, thus creating an upper and lower row of folded walkers. To ensure sufficient space between the legs/wheels of the upper walkers and top of the lower walkers, it is preferable to have a minimum distance of 16 inches from the lower edge of the bottom support section of the superior rack and the upper edge of the top support section of the inferior rack.

To accommodate for varying wheel sizes, the bottom support section should preferably be a minimum of 3 inches from the wall. This provides space for wheels to pivot with the walkers during lateral movement without creating friction against the wall.

It is contemplated that the components of the present invention can be constructed from many different materials including plastic, wood, and a variety of metals. Variations are also contemplated. For example, the J-hooks could be provided with spring loaded hooks or tension clasps. Also, the U-hooks can be made by a single bracket, or can be made by providing two pegs, spaced approximately 1.25 inches apart, allowing them to position and control lateral excursion of the lower portion of the walkers. Both the top and bottom support sections can be customized to any length to accommodate for a variable number of folding walkers.

It is contemplated that the top and bottom support sections (3) (6) can be combined into one unit if desired. It is contemplated that the "one unit" can be bent from a single continuous beam (with open or closed section), or that the "one unit" can be a weldment or other combination of short beams.

The present apparatus can be fastened to a variety of surfaces including walls, the inside of a motorized vehicle (such as with home healthcare providers), or a cart (easy mobility of multiple walkers, often utilized within the university/educational setting or for convenient tradeshow displays).

Although the presented invention is specifically designed to house folding walkers, there are a variety of other devices that could possibly be stored within the same unit including: hemi-walkers, canes, varying types of crutches, gardening utensils (i.e. rakes and shovels), and sport equipment (i.e. golf clubs).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An apparatus comprising: A storage device attached to a vertical support surface; and a plurality of folding walkers each having a frame releasably attached to the storage device in a vertical orientation adjacent the support surface, the frames each having a central section and right and left side sections that fold against the central section when stored;

the storage device including a plurality of J-shaped upper retainers on the support surface, each of the J-shaped upper retainers having a hook tip that extends toward the vertical support surface to thus be shaped to engage a wall-adjacent upper portion of a selected one of the walker frames and hold the selected walker frame vertically against outward movement based on gravity and also hold the walker frame adjacent the vertical support surface while permitting rotation of the walker frame about a vertical axis for optimal viewing of the walker frame; and a plurality of lower retainers on the support surface, each lower retainer having a pair of tips extending away from the vertical support surface to thus be shaped to engage a lower portion of the walker frame and thus hold the lower portion stably below the upper portion while still permitting rotation of the frame on the vertical support surface for inspection.

2. The storage device of claim 1, wherein the upper retainers are horizontally-spaced J-hooks.

3. The storage device of claim 2, wherein the lower retainers are horizontally-spaced U-hooks.

4. The storage device of claim 3, wherein the vertical support surface is a building wall.

5. The storage device of claim 4, wherein the J-hooks include a curled finger defining a storage area for holding the upper portion of the walker, the curled finger defining a laterally-facing access opening large enough to allow a tube of the upper portion to pass through into a storage area behind an end of the curled finger so when engaged and hanging by gravity, the upper portion of the frame does not tend to move toward the access opening.

6. The storage device of claim 5, including a structural support member attached to the vertical support surface and supporting at least one of the upper and lower retainers on the support surface.

7. A method of storing folding walkers comprising:

providing a plurality of folding walkers, each having a frame including a central section and right and left side sections that fold against the central section when stored;

providing a plurality of upper retainers on a wall-simulating support surface, each being J-shaped with a hook tip that extends toward the vertical support surface to thus be shaped to engage a wall-adjacent upper portion of a selected one of the walker frames and hold the selected walker frame vertically against outward movement based on gravity and also hold the walker frame adjacent the vertical support surface while permitting rotation of the walker frame about a vertical axis for optimal viewing of the walker frame;

providing a plurality of lower retainers each having a pair of tips extending away from the vertical support surface to thus be shaped to engage a lower portion of the walker frame and thus hold the lower portion stably below the upper portion while still permitting rotation of the frame on the vertical support surface for inspection; and hanging a plurality of folded walker frames on the wall-simulating support surface by engaging the upper portion of each walker frame on a selected one of the upper retainers to support the walkers' weight, with the lower portion of each selected one walker frame engaging the lower retainer for vertical stability.

8. The method of claim 7, including inspecting each of the plurality of folded walker frames by rotating each walker frame laterally so that adjacent ones of the walker frames can be better seen.

9. The method of claim 8, including selecting any one of the walker frames and removing the selected one walker frame from the wall-simulating support surface.

10. The method of claim 7, wherein the upper retainers are horizontally-spaced equal distances apart.

11. The method of claim 7, wherein the lower retainers are horizontally-spaced equal distances apart.

12. The method of claim 7, wherein the support surface is a building wall.

13. The method of claim 7, wherein the upper retainers include a curled finger defining a storage area for holding the upper portion of the walker frames, the curled finger defining a laterally-facing access opening large enough to allow a tube of the upper portion to pass through into the storage area behind an end of the curled finger so when engaged and hanging by gravity, the upper portion of the frame does not tend to move toward the access opening.

14. The method of claim 7, including at least one structural support member supporting the upper and lower retainers, and including a step of attaching the at least one structural support member to the vertical support surface to support the upper and lower retainers on the support surface.

15. A storage device adapted for attachment to a vertical support surface for storing folding walkers having a frame adjacent the support surface in a vertical orientation, comprising:

an upper subframe comprising a first horizontal beam with first wall-engaging flanges and a first center flange spaced from the support surface by the first wall-engaging flanges;

a lower subframe comprising a second horizontal beam with second wall-engaging flanges and a second center flange spaced from the support surface by the second wall-engaging flanges;

a plurality of J-shaped upper retainers engaging and supported by the first center flange, each of the J-shaped upper retainers having a hook tip that extends toward the vertical support surface to thus be shaped to engage a wall-adjacent upper portion of a selected one of the walker frames and hold the selected walker frame against outward movement based on gravity and also hold the walker frame adjacent the vertical support surface while permitting rotation of the walker frame about a vertical axis for optimal viewing of the walker frame; and a plurality of lower retainers engaging and supported by the second central flange, each lower retainer having a pair of tips extending away from the vertical support surface to thus be shaped to engage a lower portion of the walker frame and thus hold the lower portion stably below the upper portion while still permitting rotation of the frame on the vertical support surface for inspection.

16. A method of storing folding walkers comprising:

providing a plurality of folding walkers, each having a frame including a central section and right and left side sections that fold against the central section when stored;

providing a plurality of upper retainers on a wall-simulating support surface, each having a hook tip that extends toward the vertical support surface to thus be shaped to engage a wall-adjacent upper portion of a selected one of the walker frames and hold the selected walker frame against outward movement based on gravity and also hold the walker frame adjacent the vertical support surface while permitting rotation of the walker frame about a vertical axis for optimal viewing of the walker frame;

providing a plurality of lower retainers each having a pair of tips extending away from the vertical support surface to thus be shaped to engage a lower portion of the walker frame and thus hold the lower portion stably below the upper portion while still permitting rotation of the frame on the vertical support surface for inspection; and hanging a plurality of folded walker frames on the wall-simulating support surface by engaging the upper portion of each walker frame on a selected one of the upper retainers to support the walkers' weight, with the lower portion of each selected one walker frame engaging the lower retainer for vertical stability.

* * * * *